US010440466B2

(12) United States Patent
Chang et al.

(10) Patent No.: US 10,440,466 B2
(45) Date of Patent: Oct. 8, 2019

(54) SPEAKER MODULE

(71) Applicant: Acer Incorporated, New Taipei (TW)

(72) Inventors: Jia-Ren Chang, New Taipei (TW); Wan-Chi Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 15/984,438

(22) Filed: May 21, 2018

(65) Prior Publication Data

US 2019/0182581 A1 Jun. 13, 2019

Related U.S. Application Data

(60) Provisional application No. 62/595,595, filed on Dec. 7, 2017.

(30) Foreign Application Priority Data

Mar. 1, 2018 (TW) ..... 107106764 A

(51) Int. Cl.
*H04R 1/28* (2006.01)

(52) U.S. Cl.
CPC ..... *H04R 1/288* (2013.01); *H04R 1/2803* (2013.01); *H04R 1/2811* (2013.01); *H04R 2201/029* (2013.01); *H04R 2499/11* (2013.01)

(58) Field of Classification Search
CPC ..... H04R 1/28; B01D 53/04
USPC ..... 381/346, 345, 347, 348
See application file for complete search history.

(56) References Cited

U.S. PATENT DOCUMENTS

| | | | | |
|---|---|---|---|---|
| 9,838,765 | B1 | 12/2017 | Li et al. | |
| 2013/0308812 | A1* | 11/2013 | Shen | H04R 1/288 381/346 |
| 2015/0072723 | A1 | 3/2015 | Schoffmann et al. | |
| 2016/0345090 | A1* | 11/2016 | Wilk | B01D 53/04 |
| 2017/0064438 | A1* | 3/2017 | Wilk | H04R 1/2811 |
| 2017/0164114 | A1* | 6/2017 | Guenther | H04R 1/2819 |

FOREIGN PATENT DOCUMENTS

| | | |
|---|---|---|
| CN | 107071668 | 8/2017 |
| TW | 201717662 | 5/2017 |
| WO | 2016165318 | 10/2016 |
| WO | 2016165354 | 10/2016 |
| WO | 2016165355 | 10/2016 |
| WO | 2016186717 | 11/2016 |
| WO | 2017020849 | 2/2017 |

* cited by examiner

*Primary Examiner* — Melur Ramakrishnaiah
(74) *Attorney, Agent, or Firm* — JCIPRNET

(57) ABSTRACT

A speaker module including a speaker box, a diaphragm and a plurality of porous grains is provided. The diaphragm is disposed on the speaker box and adapted to receive a signal to vibrate. The porous grains are disposed in the speaker box and adapted to absorb energy of air in the speaker box.

7 Claims, 3 Drawing Sheets

SPEAKER MODULE

CROSS-REFERENCE TO RELATED APPLICATION

This application claims the priority benefits of U.S. provisional application Ser. No. 62/595,595, filed on Dec. 7, 2017 and Taiwan application serial no. 107106764, filed on Mar. 1, 2018. The entirety of each of the above-mentioned patent applications is hereby incorporated by reference herein and made a part of this specification.

BACKGROUND

Technical Field

The disclosure relates to an acoustic device, particularly to a speaker module.

Related Art

In the prior art such as a traditional closed speaker box, vibration of a diaphragm results in reflection of sound waves in the speaker box, and a pressure caused by the reflection of sound waves interferes with the vibration of the diaphragm and suppresses the amplitude of the diaphragm, such that a speaker has inferior performance at low frequency.

Although the pressure caused by the reflection of sound waves can be reduced by increasing the volume of the speaker box and the above problem can thus be reduced, as electronic products are getting lighter and thinner, the volume of the speaker box is limited. Therefore, how to achieve low frequency performance that is satisfactory to consumers by a sufficiently small speaker box is an important subject in current design of speaker modules for portable electronic products.

SUMMARY

The disclosure provides a speaker module having good low frequency performance and capable of saving arrangement space.

The speaker module of the disclosure includes a speaker box, a diaphragm and a plurality of porous grains. The diaphragm is disposed on the speaker box and adapted to receive a signal to vibrate. The porous grains are disposed in the speaker box and adapted to absorb energy of air in the speaker box.

Based on the above, in the speaker module of the disclosure, the porous grains are disposed in the speaker box. When sound waves are transmitted into pores of the porous grains and cause friction, vibrational energy of the air particles is converted into heat energy in the pores, thus reducing strength of the vibration of the air particles. Accordingly, it can be prevented that a pressure caused by reflection of the sound waves suppresses an amplitude of the diaphragm, with no need to increase the volume of the speaker box. Thus, the effects of saving arrangement space and enhancing low frequency performance are achieved, which also means that an equivalent volume of the speaker box is increased.

To make the above features and advantages of the disclosure more comprehensible, several embodiments accompanied with drawings are described in detail as follows.

DESCRIPTION OF THE EMBODIMENTS

Figure 1:
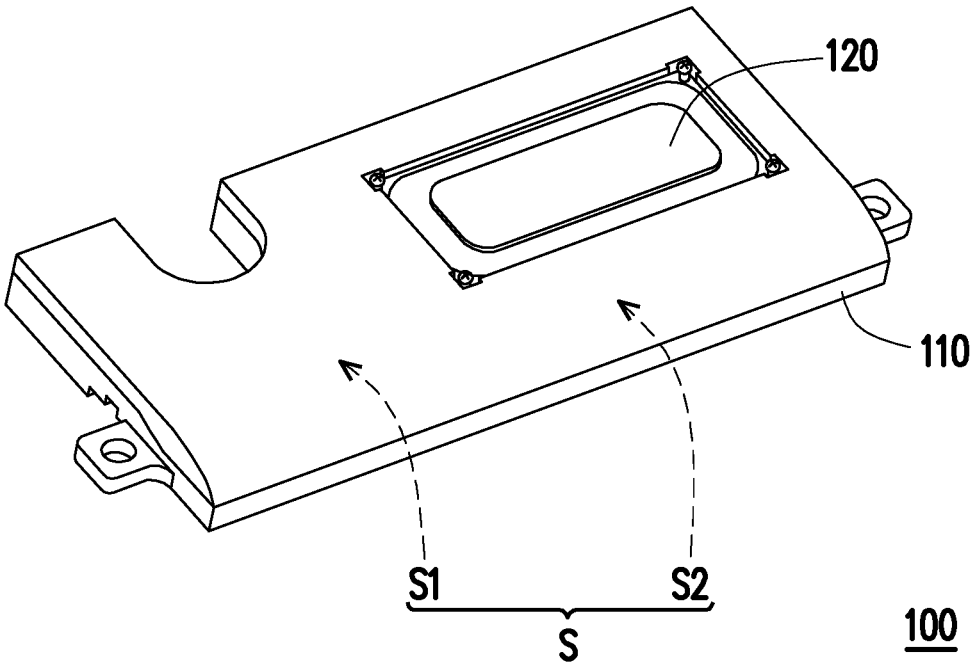
FIG. 1 is a three-dimensional view of a speaker module according to an embodiment of the disclosure.
Figure 2:
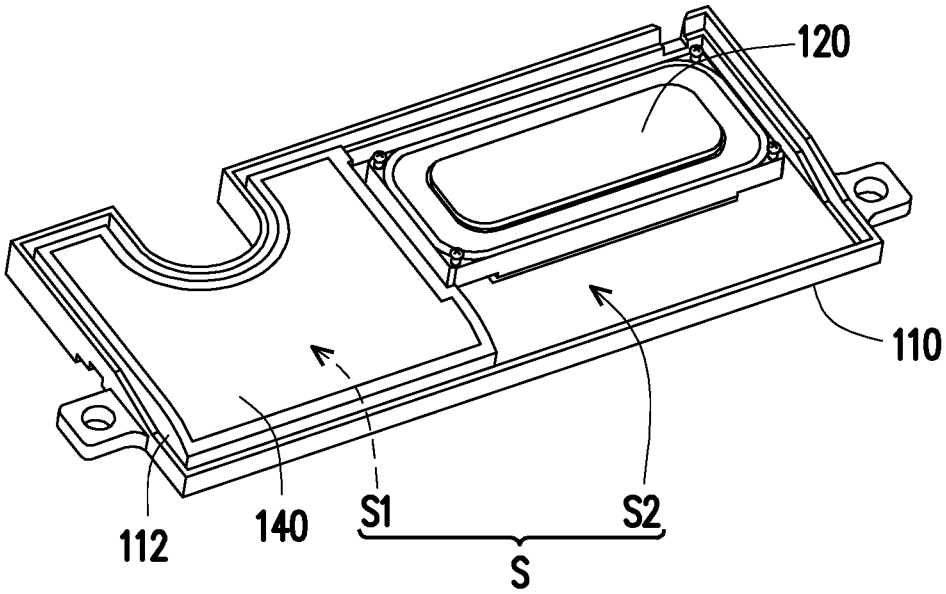
FIG. 2 is a three-dimensional view of a partial structure of the speaker module in FIG. 1.
Figure 3:
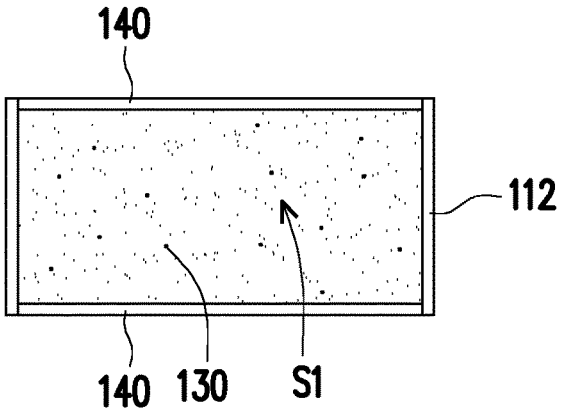
FIG. 3 is a schematic view of a blocking wall, an air-permeable film and a first space in FIG. 2.

FIG. 1 is a three-dimensional view of a speaker module according to an embodiment of the disclosure. FIG. 2 is a three-dimensional view of a partial structure of the speaker module in FIG. 1. FIG. 3 is a schematic view of a blocking wall, an air-permeable film and a first space in FIG. 2. Referring to FIG. 1 to FIG. 3, a speaker module 100 of the present embodiment includes a speaker box 110, a diaphragm 120 and a plurality of porous grains 130. The speaker box 110 has at least one blocking wall 112 therein, and the blocking wall 112 divides a containing space S of the speaker box 110 into a first space S1 and a second space S2. The porous grains 130 are filled in the first space S1 in the speaker box 110. The diaphragm 120 is disposed on the speaker box 110 and corresponds to the second space S2, and is adapted to receive a signal to vibrate. The porous grains 130 are adapted to absorb vibrational energy of air in the speaker box 110.

In detail, when the diaphragm 120 vibrates and drives the air in the speaker box 110 to vibrate, sound waves are transmitted into pores of the porous grains 130 and cause friction, so as to convert the vibrational energy of the air particles into heat energy in the pores, thus reducing strength of the vibration of the air particles. Accordingly, without the need to increase the volume of the speaker box 110, it can be prevented that a pressure caused by reflection of the sound waves suppresses an amplitude of the diaphragm 120, so that effects of saving arrangement space and enhancing low frequency performance are achieved, which also means that an equivalent volume of the speaker box is increased. An actual volume of the speaker box 110 of the present embodiment is, for example, larger than 0 ml and smaller than or equal to 5 ml, so that the speaker box 110 can be applied in a slim type notebook computer or other slim electronic products.

In the present embodiment, the porous grains 130 are, for example, natural zeolite powders, and a grain size of each of the porous grains 130 is, for example, 0.3 mm to 0.6 mm. However, the disclosure is not limited thereto, and grains of other suitable grain sizes and grains composed of other suitable porous materials may be used. In addition, the volume of the first space S1 is, for example, 40% of the volume of the containing space S of the speaker box 110. The porous grains 130 fill the first space S1 so that a total volume of the porous grains 130 is also 40% of the volume of the speaker box 110. However, the disclosure is not limited thereto.

In the present embodiment, the speaker module 100 includes at least one air-permeable film 140 (two are illustrated in FIG. 3). The two air-permeable films 140 respectively cover two opposing ends of the first space S1. The first space S1 is located between the two air-permeable films 140 such that the air in the speaker box 110 can circulate in the first space S1 and contact the porous grains 130. The air-permeable film 140 is made of, for example, nonwoven fabric or other suitable air-permeable materials. The disclosure is not limited thereto.

Figure 4:
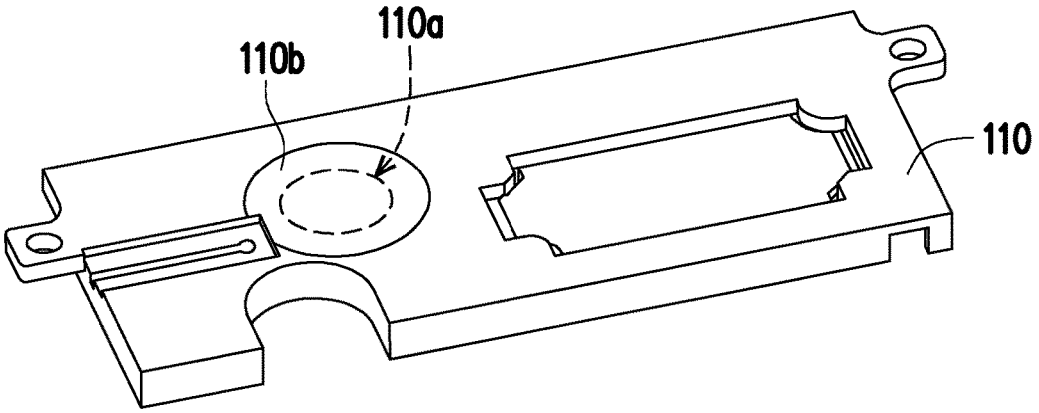
FIG. 4 is a three-dimensional view of the speaker module in FIG. 1 from another view angle.

FIG. 4 is a three-dimensional view of the speaker module in FIG. 1 from another view angle. Referring to FIG. 4, an opening 110*a* may be provided on a back surface of the speaker box 110. The porous grains 130 may be filled into the first space S1 via the opening 110*a*, and after the filling is completed, the opening 110*a* is covered by a cover body 110*b*. In other embodiments, a component filled with porous grains may be fabricated in advance and then be installed into the speaker box. Details thereof are as follows.

Figure 5:
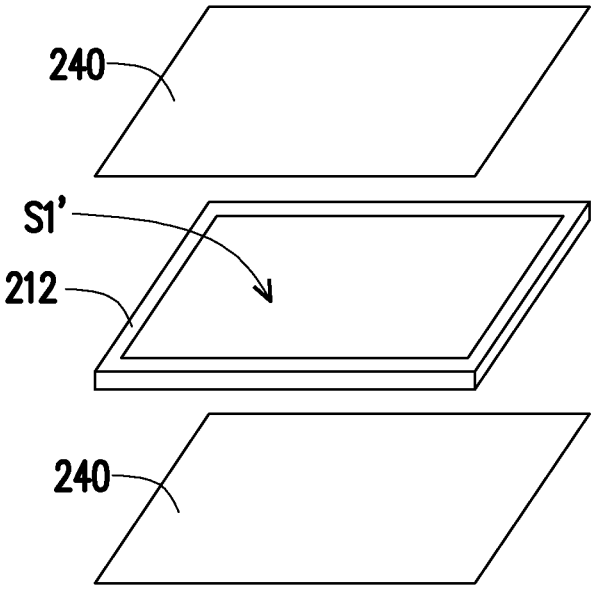
FIG. 5 is an exploded view of a part of members of a speaker module according to another embodiment of the disclosure.

FIG. 5 is an exploded view of a part of members of a speaker module according to another embodiment of the disclosure. In FIG. 5, two air-permeable films 240 are similar to the air-permeable film 140 shown in FIG. 2 and FIG. 3. An adhesive material 212 is adhered between the two air-permeable films 240 to form a blocking wall similar to the blocking wall 112 shown in FIG. 2 and FIG. 3. A first space S1' surrounded by this blocking wall is similar to the first space S1 shown in FIG. 1 to FIG. 3. The embodiment shown in FIG. 5 differs from the embodiment shown in FIG. 1 to FIG. 3 in that, porous grains are first sealed in the first space S1' between the air-permeable films 240 and the adhesive material 212, and a component including the air-permeable films 240, the adhesive material 212 and the porous grains filled between the air-permeable films 240 and the adhesive material 212 is then installed into a speaker box. A material of the adhesive material 212 includes, for example, an epoxy resin, chloroprene rubber, or other suitable adhesive materials. The disclosure is not limited thereto.

In summary, in the speaker module of the disclosure, the porous grains are disposed in the speaker box. When sound waves are transmitted into pores of the porous grains and cause friction, vibrational energy of the air particles is converted into heat energy in the pores, thus reducing strength of the vibration of the air particles. Accordingly, it can be prevented that a pressure caused by reflection of the sound waves suppresses an amplitude of the diaphragm, with no need to increase the volume of the speaker box. Thus, the effects of saving arrangement space and enhancing low frequency performance are achieved, which also means that an equivalent volume of the speaker box is increased.

Although the disclosure has been described with reference to the above examples, it will be apparent to one of ordinary skill in the art that modifications to the described examples may be made without departing from the spirit of the disclosure. Accordingly, the scope of the disclosure will be defined by the attached claims and not by the above detailed descriptions.

What is claimed is:

1. A speaker module comprising:

a speaker box;

a diaphragm disposed on the speaker box and adapted to receive a signal to vibrate; and a plurality of porous grains disposed in the speaker box and adapted to absorb energy of air in the speaker box; and two air-permeable films, wherein the speaker box has at least one blocking wall therein, the blocking wall dividing a containing space of the speaker box into a first space and a second space, the porous grains filling the first space, and the diaphragm corresponding to the second space, and wherein the air-permeable films cover the first space, and the first space is located between the two air-permeable films.

2. The speaker module according to claim 1, wherein a total volume of the porous grains is 40% of a volume of the speaker box.

3. The speaker module according to claim 1, wherein a grain size of each of the porous grains is 0.3 mm to 0.6 mm.

4. The speaker module according to claim 1, wherein the porous grains are natural zeolite powders.

5. The speaker module according to claim 1, wherein a volume of the speaker box is larger than 0 ml and smaller than or equal to 5 ml.

6. The speaker module according to claim 1, wherein a volume of the first space is 40% of a volume of the containing space of the speaker box.

7. The speaker module according to claim 1, comprising an adhesive material, wherein the adhesive material is adhered between the two air-permeable films to form the blocking wall.

* * * * *